US010795296B2

(12) United States Patent
Tanaka et al.

(10) Patent No.: US 10,795,296 B2
(45) Date of Patent: Oct. 6, 2020

(54) FUSER INCLUDING ENDLESS BELT AND SLIDING SHEET

(71) Applicant: Brother Kogyo Kabushiki Kaisha, Nagoya-shi, Aichi-ken (JP)

(72) Inventors: Tokifumi Tanaka, Komaki (JP); Hideki Kanada, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/137,672

(22) Filed: Sep. 21, 2018

(65) Prior Publication Data

US 2019/0243294 A1 Aug. 8, 2019

(30) Foreign Application Priority Data

Feb. 5, 2018 (JP) ..... 2018-018548
Apr. 10, 2018 (JP) ..... 2018-075194

(51) Int. Cl.
*G03G 15/20* (2006.01)

(52) U.S. Cl.
CPC ..... *G03G 15/2057* (2013.01); *G03G 15/2064* (2013.01)

(58) Field of Classification Search
USPC ..... 399/331
See application file for complete search history.

(56) References Cited

U.S. PATENT DOCUMENTS 7,379,697 B2 5/2008 Ito et al.
8,032,068 B2 10/2011 Hanyu et al.
8,195,072 B2 6/2012 Okuno
8,909,116 B2 12/2014 Ohtsu
8,958,733 B2 2/2015 Nishida et al.
9,002,254 B2 4/2015 Ohtsu
9,008,560 B2 4/2015 Otsu
2006/0083567 A1 4/2006 Ito et al.
2009/0014942 A1 1/2009 Okuno
2009/0208263 A1 8/2009 Hanyu et al.
(Continued)

FOREIGN PATENT DOCUMENTS

JP 2003-076178 A 3/2003
JP 2004-37552 A 2/2004
(Continued)

OTHER PUBLICATIONS

Apr. 8, 2019—U.S. Notice of Allowance—U.S. Appl. No. 16/137,646.
(Continued)

*Primary Examiner* — Quana Grainger
(74) *Attorney, Agent, or Firm* — Banner & Witcoff, Ltd.

(57) ABSTRACT

A fuser includes a rotatable member, a belt, a pressure member, and a sliding member. The pressure member sandwiches the belt together with the rotatable member to form a nip portion. The sliding member is sandwiched between an inner peripheral surface of the belt and the pressure member. The sliding member includes a front surface, which faces the inner peripheral surface of the belt. The front surface includes a plurality of first dimples and a plurality of second dimples. The first dimples are arranged in a first zone, which corresponds to the nip portion. The second dimples are arranged in a second zone, which corresponds to a portion of the sliding member outside the nip portion. Each of the first dimples is of a shape that can release lubricant more easily than each of the second dimples.

18 Claims, 8 Drawing Sheets

(56) References Cited

U.S. PATENT DOCUMENTS

| | | | |
|---|---|---|---|
| 2013/0189007 | A1 | 7/2013 | Ohtsu |
| 2013/0266354 | A1 | 10/2013 | Nishida et al. |
| 2014/0086651 | A1 | 3/2014 | Otsu |
| 2014/0205332 | A1 | 7/2014 | Otsu |
| 2015/0030362 | A1 | 1/2015 | Bae et al. |
| 2016/0274519 | A1 | 9/2016 | Lim et al. |
| 2017/0097598 | A1 | 4/2017 | Kudo et al. |
| 2017/0176905 | A1 | 6/2017 | Suzuki et al. |
| 2017/0285537 | A1 | 10/2017 | Onaka et al. |
| 2018/0292771 | A1 | 10/2018 | Kudo et al. |
| 2018/0299808 | A1 | 10/2018 | Suzuki et al. |

FOREIGN PATENT DOCUMENTS

| | | | |
|---|---|---|---|
| JP | 2006-119263 | A | 5/2006 |
| JP | 2007-147865 | A | 6/2007 |
| JP | 2009-15227 | A | 1/2009 |
| JP | 2009-198567 | A | 9/2009 |
| JP | 2009-229494 | A | 10/2009 |
| JP | 2013-148837 | A | 8/2013 |
| JP | 2013-218175 | A | 10/2013 |
| JP | 2014-63067 | A | 4/2014 |
| JP | 2014-139641 | A | 7/2014 |

OTHER PUBLICATIONS

Sep. 21, 2018—Co-Pending U.S. Appl. No. 16/137,646.
Sep. 21, 2018—Co-Pending U.S. Appl. No. 16/137,664.
Feb. 26, 2019—U.S. Non-Final Office Action—U.S. Appl. No. 16/137,664.

FUSER INCLUDING ENDLESS BELT AND SLIDING SHEET

CROSS-REFERENCE TO RELATED APPLICATIONS

This application claims priority from Japanese Patent Application No. 2018-075194, filed on Apr. 10, 2018, which claims priority from Japanese Patent Application No. 2018-018548, filed on Feb. 5, 2018. The disclosures of these applications are incorporated herein by reference in their entirety.

TECHNICAL FIELD

Aspects disclosed herein relate to a fuser for fusing a toner image onto a recording medium.

BACKGROUND

A known fuser includes a heat roller, an endless belt having lubricant on its inner circumferential surface, a nip forming member, and a sliding sheet. The nip forming member and the heat roller sandwich an endless belt therebetween to form a nip portion. The sliding sheet is disposed between a portion of an inner circumferential surface of the endless belt and the nip forming member. The sliding sheet has a surface that contacts a portion of the inner circumferential surface of the endless belt. The surface of the sliding sheet has a plurality of dimples for reducing sliding resistance occurring between the surface of the sliding sheet and the endless belt during rotation of the endless belt.

SUMMARY

A fuser includes a rotatable member, a belt, a pressure member, and a sliding member. The pressure member sandwiches the belt together with the rotatable member to form a nip portion. The sliding member is sandwiched between an inner peripheral surface of the belt and the pressure member. The sliding member includes a front surface, which faces the inner peripheral surface of the belt. The front surface includes a plurality of first dimples and a plurality of second dimples. The first dimples are arranged in a first zone, which corresponds to the nip portion. The second dimples are arranged in a second zone, which corresponds to a portion of the sliding member outside the nip portion.

In one aspect, the first dimples may comprise a first upstream dimple and a first downstream dimple, positioned downstream from the first upstream dimple in a moving direction of the belt at the nip portion. A first ridge portion may be formed between the first upstream dimple and the first downstream dimple. The second dimples may comprise a second upstream dimple and a second downstream dimple positioned downstream from the second upstream dimple in the moving direction. A second ridge portion may be formed between the second upstream dimple and the second downstream dimple. A first angle formed between the first upstream dimple and the first ridge portion may be greater than a second angle formed between the second upstream dimple and the second ridge portion In another aspect, the first dimples may comprise a first upstream dimple and a first downstream dimple, positioned downstream from the first upstream dimple in a moving direction of the belt at the nip portion. A first ridge portion may be formed between the first upstream dimple and the first downstream dimple. The second dimples may comprise a second upstream dimple and a second downstream dimple positioned downstream from the second upstream dimple in the moving direction. A second ridge portion may be formed between the second upstream dimple and the second downstream dimple. Additionally, a slope of an edge of the first upstream dimple in the moving direction relative to the first ridge portion may be steeper than a slope of an edge of the second upstream dimple in the moving direction relative to the second ridge portion.

In another aspect, an opening of each of the first dimples and an opening of each of the second dimples may have same size, and a depth of each of the first dimples may be less than a depth of each of the second dimples.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

An illustrative embodiment will be described with reference to the accompanying drawings.

Figure 1:
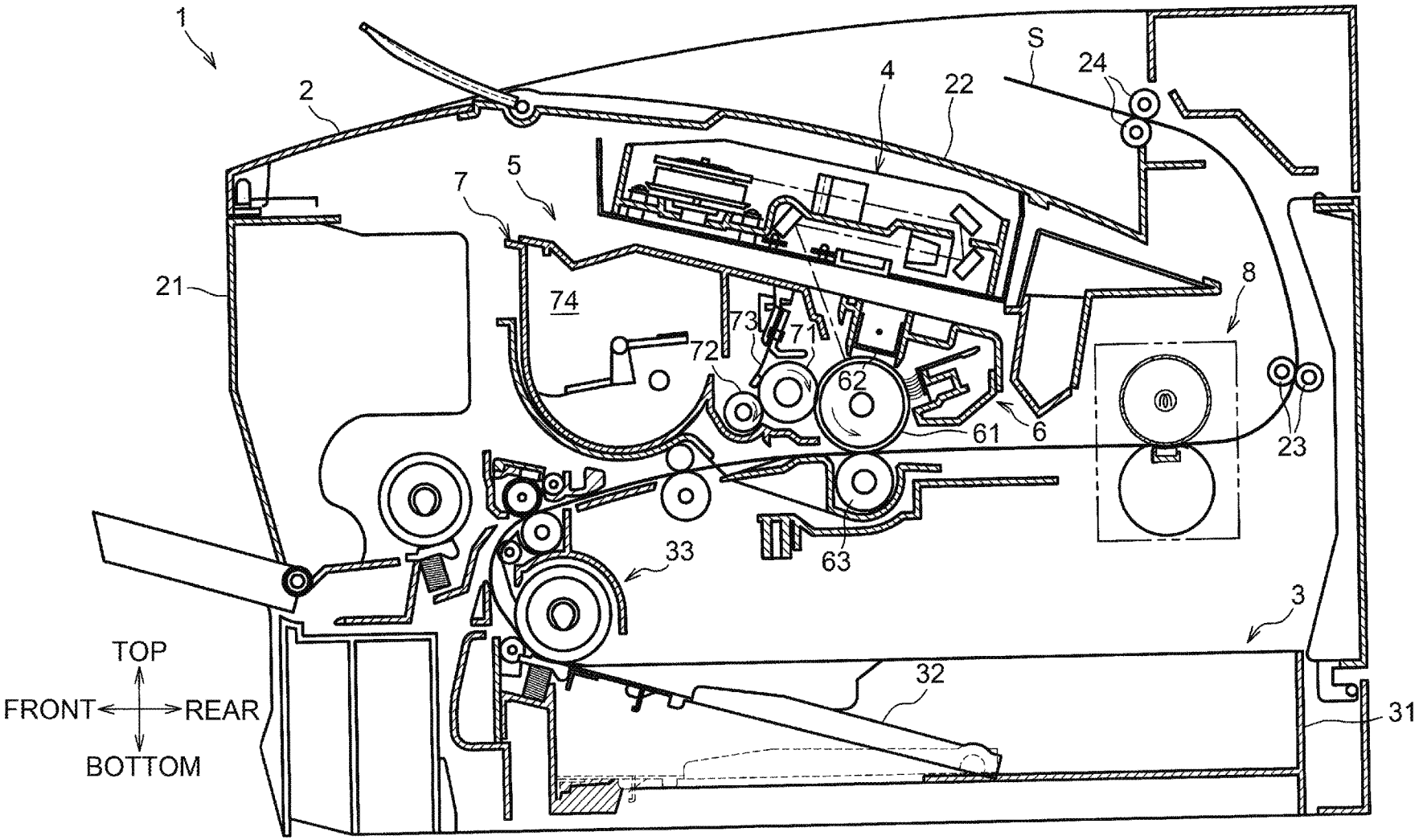
FIG. 1 is a sectional view illustrating a laser printer including a fuser in an illustrative embodiment according to one or more aspects of the disclosure.

As illustrated in FIG. 1, the laser printer 1 includes a housing 2. The laser printer 1 further includes a feed unit 3, an exposure device 4, a process cartridge 5, and a fuser 8 in the housing 2.

The feed unit 3 is disposed in a lower portion of the housing 2. The feed unit 3 includes a feed tray 31, a sheet support plate 32, and a sheet feed mechanism 33. The feed tray 31 is configured to accommodate one or more sheets S. The sheet support plate 32 is configured to raise the one or more sheets S in the feed tray 31. The sheet feed mechanism 33 is configured to feed, one by one, the raised one or more sheets S to the process cartridge 5.

The exposure device 4 is disposed in an upper portion of the housing 2. The exposure device 4 includes a light emitter (not illustrated), a polygon mirror, lenses, and reflectors (whose reference numerals are omitted). In the exposure device 4, the light source emits a laser beam based on image data to scan a circumferential surface of a photosensitive drum 61 at a high speed, thereby exposing a portion of the circumferential surface of the photosensitive drum 61.

The housing 2 has an opening defined therein. The housing 2 further includes a front cover 21 for covering the opening. The process cartridge 5 is detachably attachable to the housing 2 through the opening that is exposed when the front cover 21 is open. In a state where the process cartridge 5 is attached to the housing 2, the process cartridge 5 is placed below the exposure device 4. The process cartridge 5 includes a drum unit 6 and a developing unit 7. The drum unit 6 includes the photosensitive drum 61, a charger 62, and a transfer roller 63. The developing unit 7 is detachably attachable to the drum unit 6. The developing unit 7 includes a developing roller 71, a supply roller 72, a blade 73, and a storage 74 for storing toner.

In the process cartridge 5, the charger 62 uniformly charges the circumferential surface of the photosensitive drum 61. The photosensitive drum 61 is then formed with an electrostatic latent image on its circumferential surface based on image data by exposure with a laser beam by the exposure device 4. The supply roller 71 supplies toner onto a circumferential surface of the developing roller 71 from the storage 74. The developing roller 71 and the blade 73 cause toner to become a thin layer having uniform thickness. The developing roller 71 thus holds the thin layer of toner on its circumferential surface. The developing roller 71 further supplies toner onto the electrostatic latent image formed on the circumferential surface of the photosensitive drum 61. The photosensitive drum 61 thus holds a toner image which is a visualized electrostatic latent image, on its circumferential surface. Thereafter, the transfer roller 63 transfers the toner image onto a sheet S from the circumferential surface of the photosensitive drum 61 when the sheet S passes between the photosensitive drum 61 and the transfer roller 63.

Figure 2A:
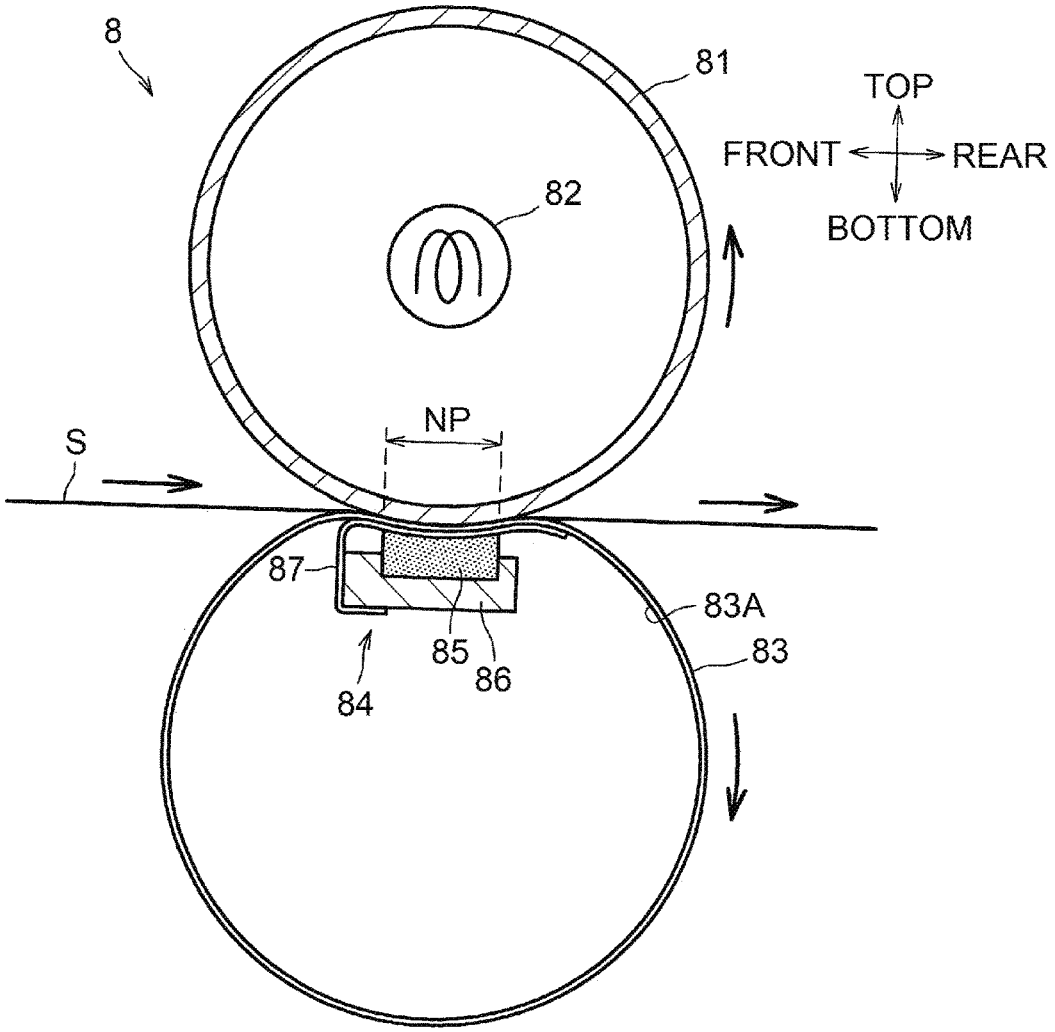
FIG. 2A is a cross-sectional view illustrating the fuser in the illustrative embodiment according to one or more aspects of the disclosure.

As illustrated in FIG. 2A, the fuser 8 includes a heat roller 81, a heater 82, an endless belt 83, and a pressure unit 84. The head roller 81 is an example of a cylindrical member. One of the heat roller 81 and the pressure unit 84 is urged toward the other to form a nip portion NP between the heat roller 81 and the endless belt 83.

In the following explanation, a direction in which the endless belt 83 extends along its rotational axis may be referred to as a "width direction". A direction in which the endless belt 83 moves at the nip portion NP when the fuser 8 fuses a toner image onto a sheet S may be referred to as a "moving direction". A direction in which the head roller 81 and the pressure unit 84 (more specifically, a pressure pad 85) face each other may be referred to as a "facing direction".

In the illustrative embodiment, the width direction corresponds to a right-left direction. The moving direction corresponds to a front-rear direction of the laser printer 1. The facing direction corresponds to a top-bottom direction of the laser printer 1.

The heat roller 81 includes a hollow cylindrical body. For example, the heat roller 81 may include a base tube made of metal such as aluminum. The base tube may have a release layer formed on its outer circumferential surface. The release layer may be made of, for example, fluorine resin. The heat roller 81 is configured to receive a driving force transmitted from a motor (not illustrated) to rotate counterclockwise in FIG. 2. The heat roller 81 is in contact with a portion of an outer circumferential surface of the endless belt 83.

The heater 82 is configured to heat the heat roller 81. The heater 82 is disposed in an internal space of the heat roller 81. The heater 82 may be, for example, a halogen lamp that emits light by energization to heat the heat roller 81 by its radiant heat.

The endless belt 83 may be a flexible cylindrical member. The endless belt 83 may include, for example, a base made of metal such as stainless steel or resin such as polyimide resin. The base may have a release layer formed on its outer circumferential surface. The release layer may be made of fluorine resin. The endless belt 83 is configured to rotate clockwise in FIG. 2 by rotation of the heat roller 81.

The endless belt 83 has an inner circumferential surface 83A which may be lubricated by lubricant such as grease. The lubricant may increase slidability between the inner circumferential surface 83A of the endless belt 83 and the pressure unit 84. This may thus enable the endless belt 83 to rotate smoothly relative to the pressure unit 84.

The pressure unit 84 includes the pressure pad 85, a holder 86, and a sliding sheet 87. The holder 86 holds the pressure pad 85. The pressure pad 85 is an example of a nip forming member.

The pressure pad 85 is disposed inside a loop of the endless belt 83. That is, the pressure pad 85 is surrounded by the endless belt 83. The pressure pad 85 may include an elastic member made of, for example, rubber. The pressure pad 85 and the heat roller 81 sandwich a portion of the endless belt 83 to form the nip portion NP therebetween. This configuration may thus enable application of heat and pressure to a sheet S having a toner image while the sheet S passes the nip portion NP, thereby fusing the toner image onto the sheet S.

The sliding sheet 87 may have a rectangular shape. The sliding sheet 87 is used for reducing friction resistance occurring between the pressure pad 85 and the endless belt 83 when the endless belt 83 rotates. The sliding sheet 87 may be made of resin containing polyimide, and has elasticity. The sliding sheet 87 is sandwiched between the inner circumferential surface 83A of the endless belt 83 and the pressure pad 85 at the nip portion NP.

For example, the sliding sheet 87 has one end (e.g., an upstream end) attached to an upstream end portion of the holder 86 in the moving direction. More specifically, for example, the sliding sheet 87 extends upward along an external shape of the upstream end portion of the holder 86 in the moving direction from a lower surface of the holder 86, and bends toward the rear. The sliding sheet 87 further extends over the holder 86 while being disposed between the pressure pad 85 and the endless belt 83. The other end (e.g., a downstream end) of the sliding sheet 87 is not fixed. Nevertheless, the other end of the sliding sheet 87 is pressed against and in contact with the inner circumferential surface 83A of the endless belt 83 by elasticity of the sliding sheet 87 itself.

In the illustrative embodiment, the other end of the sliding sheet 87 is not fixed. Nevertheless, in other embodiments, for example, the other end of the sliding sheet 87 may be fixed to the holder 86. In still other embodiments, for example, the sliding sheet 87 may be made of another material.

Figure 2B:
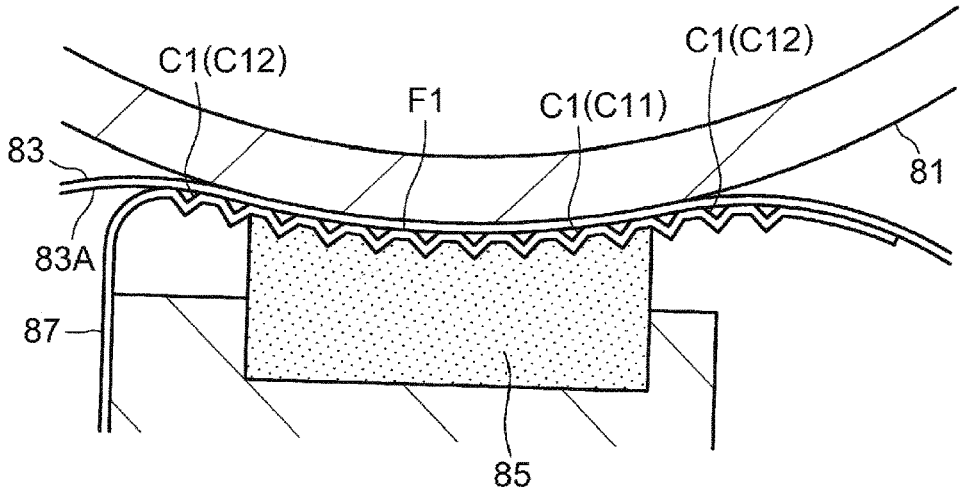
FIG. 2B is an enlarged view illustrating a nip portion and its surrounding portion in the illustrative embodiment according to one or more aspects of the disclosure.
Figure 3:
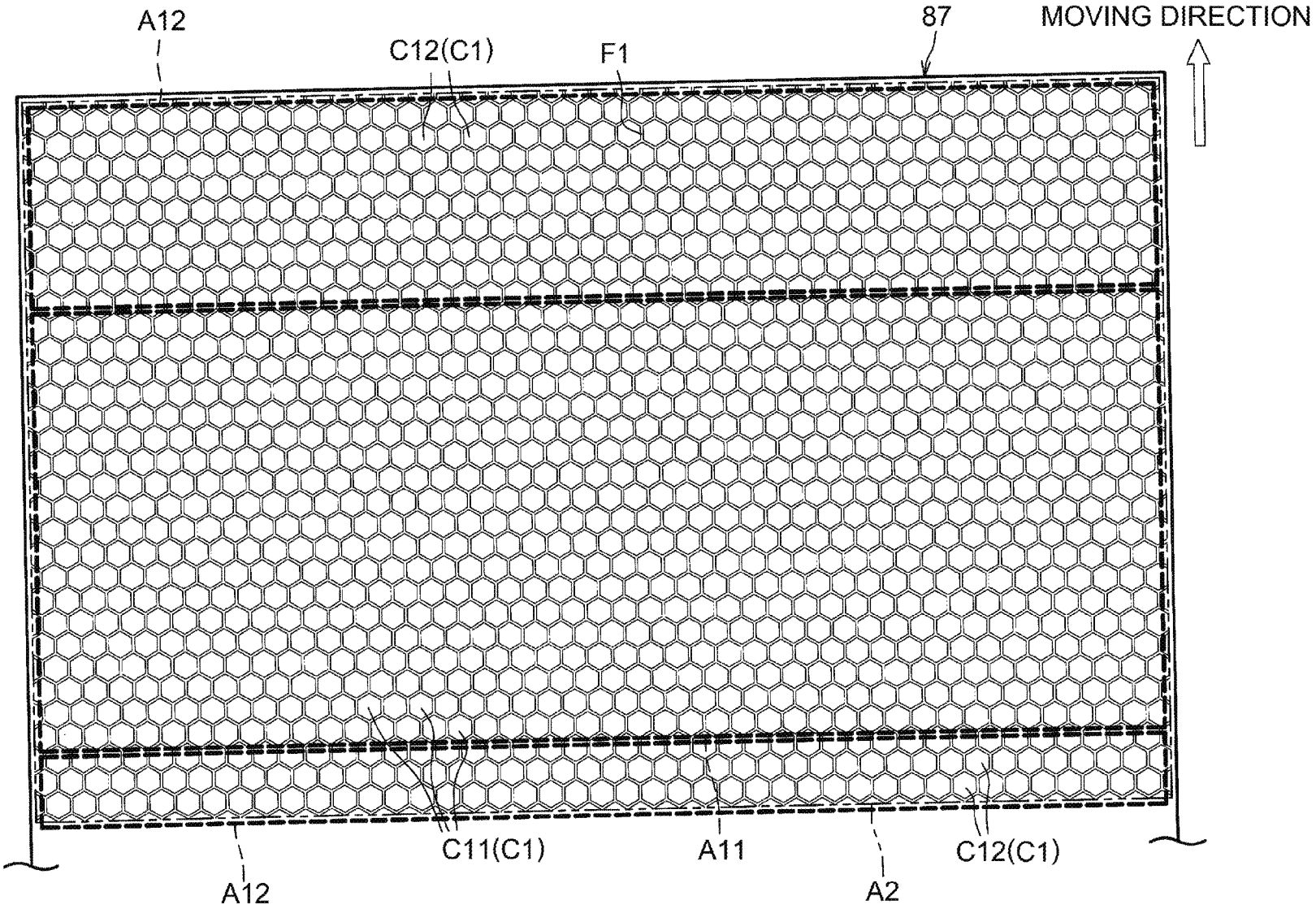
FIG. 3 illustrates a sliding sheet having a plurality of dimples including a plurality of first dimples and a plurality of second dimples in the illustrative embodiment according to one or more aspects of the disclosure.

As illustrated in FIG. 2B, the sliding sheet 87 has a surface F1 which may contact a portion of the inner circumferential surface 83A of the endless belt 83. The surface F1 of the sliding sheet 87 has a plurality of dimples C1. More specifically, for example, as illustrated in FIG. 3, the surface F1 includes a zone A11 and a plurality of zones A12. The zone A11 corresponds to the nip portion NP. The zones A12 correspond to portions of the surface F1 other than the zone A11. The dimples C1 are arranged in a regular pattern in the zones A11 and A12. More specifically, the zone A11 may receive a nip pressure applied by the heat roller 81. The zones A12 do not overlap the zone A11 and contact the inner circumferential surface 83A of the endless belt 83. The zones A12 are located upstream and downstream, respectively, from the zone A11 in the moving direction.

In the illustrative embodiment, the surface F1 further includes a section A2 including the dimples C1. The section A2 has the same dimension as the zone A11 in the width direction. The section A2 extends between an upstream end of the upstream zone A12 and a downstream end of the downstream zone A12 in the moving direction.

In one example, the surface F1 may be partially defined by the section A2. In another example, the surface F1 may be entirely defined by the section A2. In still another example, the section A2 may partially overlap the zone A11 and one or both of the zones A12. In yet another example, the section A2 may overlap a portion of the zone A11 or a portion of one or more of the zones A12. In such a case, the section A2 may be provided across the zone A11 in the width direction. In a further example, the section A2 may overlap one of the upstream zone A12 and the downstream zone A12.

The pressure pad 85 is preferably made of a material softer than the material used for the sliding sheet 87. This may enable each dimple C1 to retain its shape against pressure exerted on the sliding sheet 87 by the pressure pad 85.

The dimples C1 includes dimples C11 and dimples C12. The dimples C11 all have the same shape. The dimples C12 all have the same shape but a different shape from the shape of the dimples C11. Each dimple C11 is an example of a first dimple. Each dimple C12 is an example of a second dimple. The dimples C11 are included in the zone A11. The dimples C12 are included in the sections A12. Some of the dimples C1 may be located on a boundary between the zone A11 and the upstream zone A12 and on a boundary between the zone A11 and the downstream zone A12. Such dimples C1 may have the same shape as the dimples C11 or as the dimples C12. In other embodiments, for example, the surface F1 might not necessarily have any dimples C1 on such boundaries.

Figure 4A:
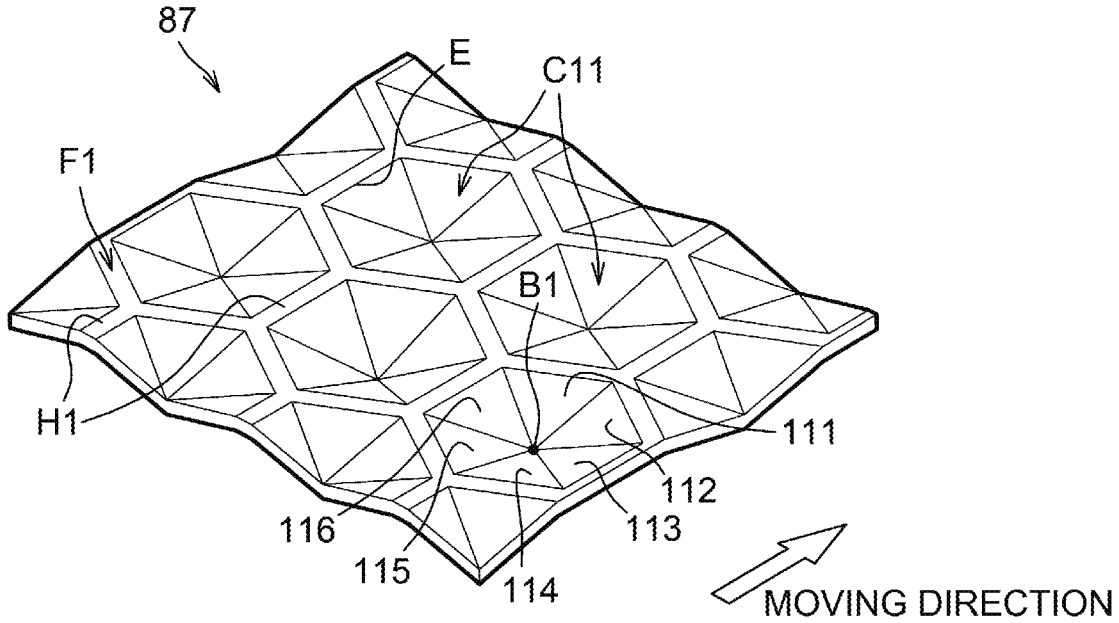
FIG. 4A is an enlarged perspective view illustrating a portion of the sliding sheet including some of the first dimples in the illustrative embodiment according to one or more aspects of the disclosure.
Figure 4B:
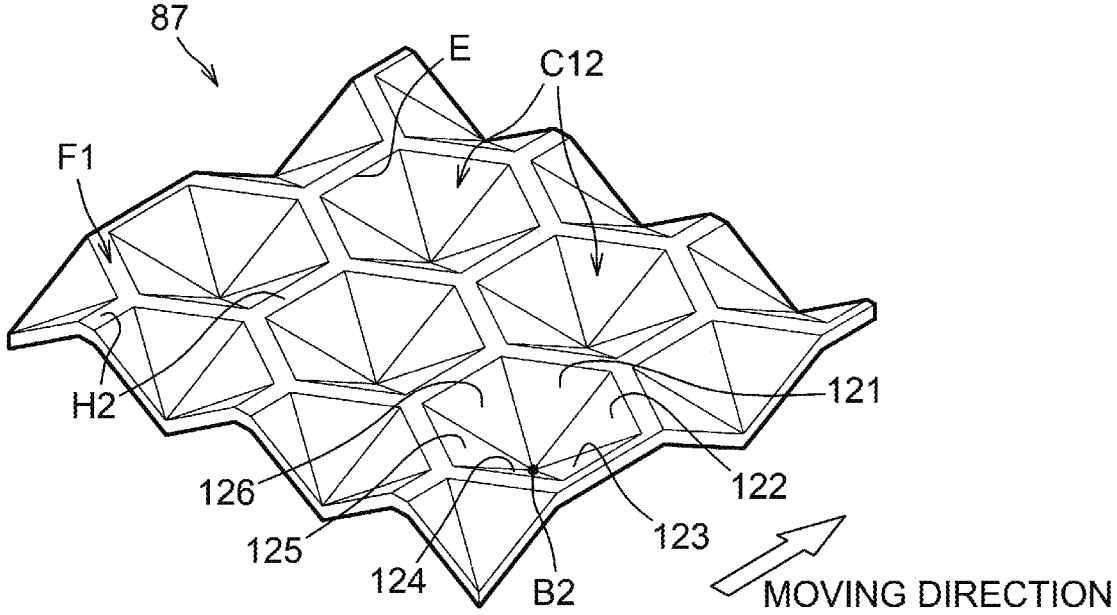
FIG. 4B is an enlarged perspective view illustrating another portion of the sliding sheet including some of the second dimples in the illustrative embodiment according to one or more aspects of the disclosure.

As illustrated in FIGS. 4A and 4B, each of the dimples C11 and C12 has an opening E having a regular hexagonal shape when viewed in a direction perpendicular to the surface F1. The dimples C11 are spaced from each other by a predetermined distance and arranged in a regular pattern, e.g., in a honeycomb lattice. Likewise, the dimples C12 are spaced from each other by a predetermined distance and arranged in a regular pattern, e.g., in a honeycomb lattice. Hereinafter, an arbitrary one of each of the dimples C11 and the dimples C12 will be described in detail, and a description for the others will be omitted as appropriate.

A dimple C11 is defined by a plurality of, for example, six, triangular inclined surfaces 111, 112, 113, 114, 115, and 116 to form in an inverted hexagonal pyramid shape having a bottom B1 (e.g., a vertex). The inclined surfaces 111 and 112 are located downstream of the dimple C11 with respect to the bottom B1 in the moving direction. The inclined surface 113 and the inclined surface 116 are located opposite to each other with respect to the bottom B1 in the width direction. The inclined surfaces 114 and 115 are located upstream of the dimple C11 with respect to the bottom B1 in the moving direction.

A dimple C12 is defined by a plurality of, for example, six, triangular inclined surfaces 121, 122, 123, 124, 125, and 126 to form in an inverted hexagonal pyramid shape having a bottom B2 (e.g., a vertex). The inclined surfaces 121 and 122 are located downstream of the dimple C12 with respect to the bottom B2 in the moving direction. The inclined surface 123 and the inclined surface 126 are located opposite to each other with respect to the bottom B2 in the width direction. The inclined surfaces 124 and 125 are located upstream of the dimple C12 with respect to the bottom B2 in the moving direction.

The dimple C11 has a shallower depth than the dimple C12. Each of the inclined surfaces 111 to 116 of the dimple C11 thus has a more gentle inclination than each of the inclined surfaces 121 to 126 of the dimple C12, thereby enabling the dimple C11 to release lubricant in the moving direction more easily than the dimple C12.

The surface F1 of the sliding sheet 87 includes ridges H1 and ridges H2 each having a flattened top. The ridges H1 are located between the dimples C11. The ridges H2 are located between the dimples C12. More specifically, for example, each ridge H1 is located between two arbitrary adjacent dimples C11. Each ridge H2 is located between two arbitrary adjacent dimples C12.

Figure 5A:
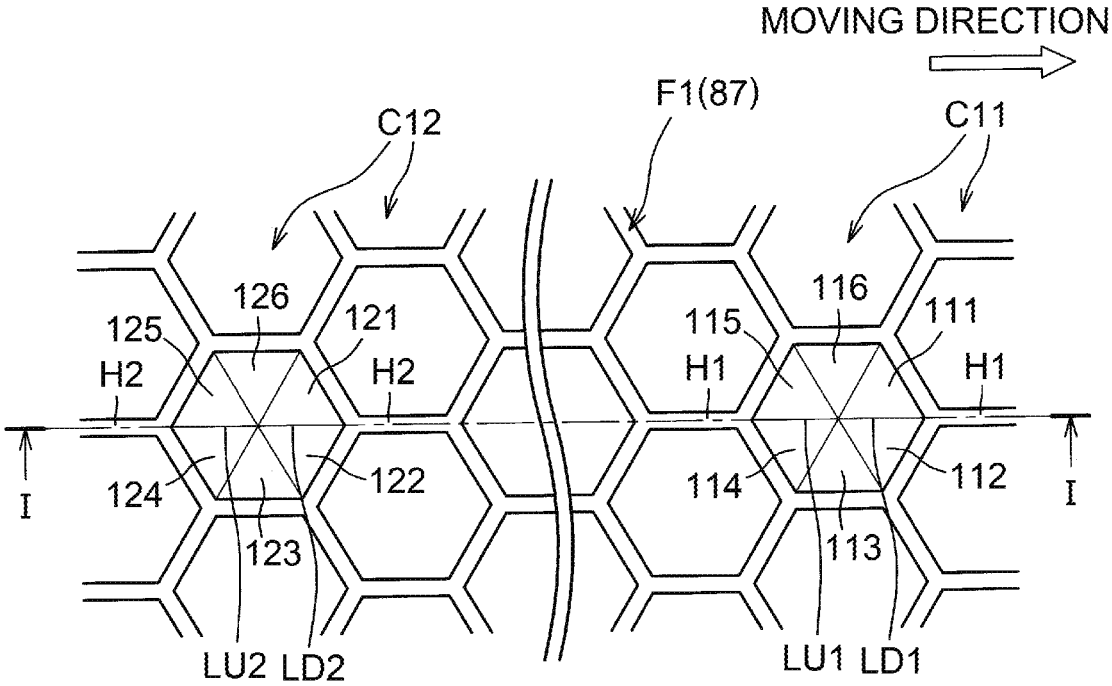
FIG. 5A is an enlarged perspective view illustrating a portion of the sliding sheet including some of the first dimples and some of the second dimples in the illustrative embodiment according to one or more aspects of the disclosure.
Figure 5B:
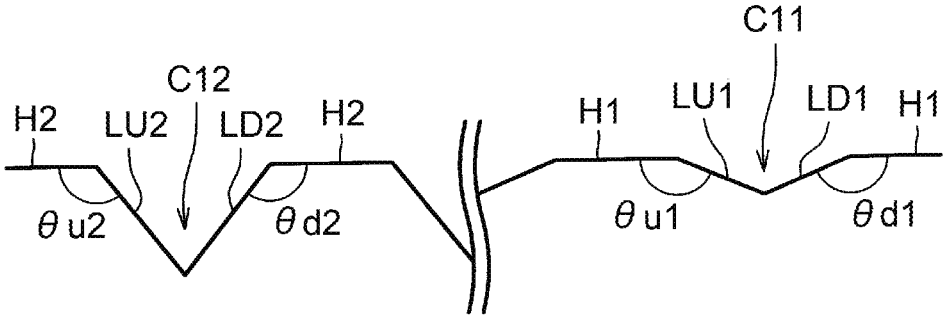
FIG. 5B is a cross-sectional view taken along line I-I of FIG. 5A in the illustrative embodiment according to one or more aspects of the disclosure.

As illustrated in FIGS. 5A and 5B, the dimple C11 includes a linear portion LD1 in its downstream portion including the inclined surface 111 and the inclined surface 112. The linear portion LD1 may be a straight line in cross section taken along the moving direction when cutting straight through the sliding sheet 87 in a direction perpendicular to the surface F1. More specifically, for example, the linear portion LD1 is located on a boundary between the inclined surface 111 and the inclined surface 112. Hereinafter, "some shape in cross section taken along the moving direction when cutting straight through the sliding sheet 87 in a direction perpendicular to the surface F1" may be simply referred to as a "cross-sectional shape" or "some shape in cross section".

The dimple C11 further includes a linear portion LU1 in its upstream portion including the inclined surface 114 and the inclined surface 115. The linear portion LD1 may be a straight line in cross section. More specifically, for example, the linear portion LU1 is located on a boundary between the inclined surface 114 and the inclined surface 115. The linear portion LD1 and a ridge H1 connecting to the linear portion LD1 forms an angle θd1. The linear portion LU1 and a ridge H1 connecting to the linear portion LU1 form an angle θu1. The angle θd1 is equal to the angle θu1.

The dimple C12 includes a linear portion LD2 in its downstream portion including the inclined surface 121 and the inclined surface 122. The linear portion LD2 may be a straight line in cross section. More specifically, for example, the linear portion LD2 is located on a boundary between the inclined surface 121 and the inclined surface 122. The dimple C12 further includes a linear portion LU2 in its upstream portion including the inclined surface 124 and the inclined surface 125. The linear portion LD2 may be a straight line in cross section. More specifically, for example, the linear portion LU2 is located on a boundary between the inclined surface 124 and the inclined surface 125. The linear portion LD2 and a ridge H2 connecting to the linear portion LD2 form an angle θd2. The linear portion LU2 and a ridge H2 connecting to the linear portion LU2 form an angle θu2. The angle θd2 is equal to the angle θu2.

The angles θd1, θu1, θd2, and θu2 may each be larger than or equal to 90 degrees and smaller than 180 degrees.

The angle θd1 is larger than the angle θd2. This configuration may thus enable the dimple C11 to release lubricant in the moving direction more easily than the dimple C12. In addition, the angle θu1 of the dimple C11 is larger than the angle θu2 of the dimple C12. More specifically, the angles θd1 and θu1 may each preferably be larger than or equal to 165 degrees, and more preferably be larger than or equal to 170 degrees. The angles θd2 and θu2 may each preferably be smaller than 165 degrees, and more preferably be smaller than or equal to 160 degrees.

In the illustrative embodiment, the cross-sectional shape of the dimples C1 may be a shape in cross section taken when cutting straight through the sliding sheet 87 such that a cutting plane passes through the bottom B1 of the dimple C11 and the bottom B2 of the dimple C12. Nevertheless, the dimple C11 and the dimple C12 may include such linear portions in cross section when cutting straight through the sliding sheet 87 such that a cutting plane does not pass through the bottom B1 of the dimple C11 and the bottom B2 of the dimple C12. In such a case, the relationship between the linear portions may be the same or similar to the relationship between the linear portions LD1, LU1, LD2, LU2 described above.

The illustrative embodiment may thus achieve the following effects.

The dimple C11 included in the zone A11 has such a shape that tends to release lubricant in the moving direction more easily than the dimple C12 positioned out of the zone A11. If, therefore, foreign matter such as wear dust or wear debris intrudes into the dimple C11, the dimple C11 may release the foreign matter therefrom together with lubricant, thereby reducing accumulation of foreign matter in the dimple C11. On the other hand, the dimple C12 has a higher lubricant-holding capability than the dimple C11, thereby collecting foreign matter therein.

While the disclosure has been described in detail with reference to the specific embodiment thereof, this is merely an example, and various changes, arrangements and modifications may be applied therein without departing from the spirit and scope of the disclosure. In the following alternative embodiments, an explanation will be given mainly for the parts different from the illustrative embodiment, and an explanation will be omitted for the common components by assigning the same reference numerals thereto.

In the illustrative embodiment, while the dimple C11 and the dimple C12 each have the opening E having a regular hexagonal shape, the dimple C11 and the dimple C12 have the different depths. Nevertheless, the first dimple and the second dimple may have any shape if the first dimple has such a shape that tends to release lubricant therefrom in the moving direction more easily than the second dimple. Hereinafter, alternative embodiments illustrate various example first and second dimples.

Figure 6:
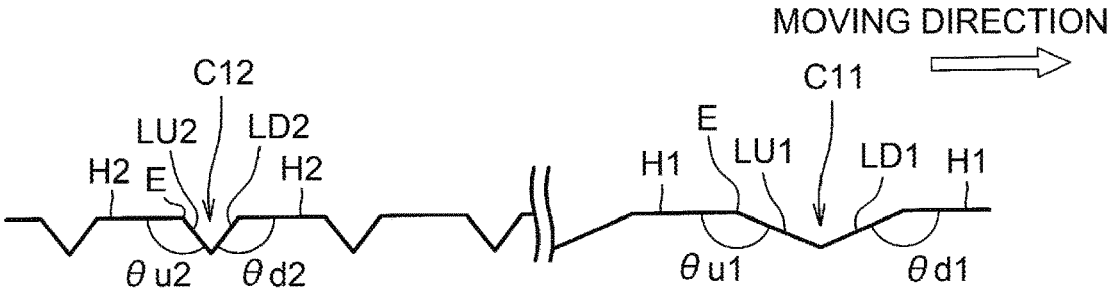
FIG. 6 is a cross-sectional view illustrating a portion of a sliding sheet including a first dimple and a second dimple in a first alternative embodiment according to one or more aspects of the disclosure.

In a first alternative embodiment, as illustrated in FIG. 6, a dimple C11 has a larger opening E than a dimple C12, and the dimple C11 and the dimple C12 have the same depth. The opening E of the dimple C12 is the same size as the opening E of the dimple C12 according to the illustrative embodiment. Further, the depth of the dimple C12 is the same as the depth of the dimple C12 according to the illustrative embodiment. A relationship between angles θd1, θd2, θu1, and θu2 according to the first alternative embodiment is the same as the relationship between the angles θd1, θd2, θu1, and θu2 according to the illustrative embodiment. Further, the angles θd1, θd2, θu1, and θu2 according to the first alternative embodiment have the same preferable range as the angles θd1, θd2, θu1, and θu2, respectively, according to the illustrative embodiment. Such a dimple C11 may thus have a larger capacity than the dimple C11 according to the illustrative embodiment, thereby enabling the zone A11 to retain lubricant therein sufficiently.

Figure 7:
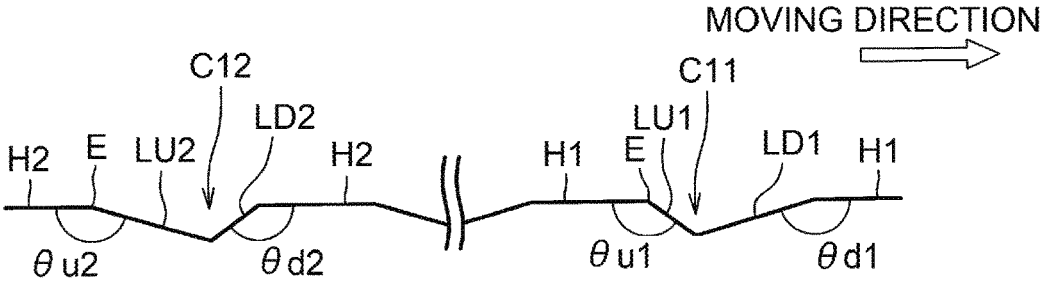
FIG. 7 is a cross-sectional view illustrating a portion of a sliding sheet including a first dimple and a second dimple in a second alternative embodiment according to one or more aspects of the disclosure.

In a second alternative embodiment, as illustrated in FIG. 7, an angle θd1 of a dimple C11 is larger than an angle θd2 of a dimple C12. Further, the angle θd1 is equal to an angle θu2 of the dimple C12, and the angle θd2 is equal to an angle θu1 of the dimple C11. The opening E of the dimple C11 and the opening E of the dimple C12 have the same shape as with the illustrative embodiment. The dimple C11 and the dimple C12 have thus the same depth.

Such a configuration may therefore enable the dimple C11 and the dimple C12 to have an equal capacity. Consequently, the dimple C11 having the angle θd1 larger than the angle θd2 of the dimple C12 may retain the same amount of lubricant as the dimple C12, thereby reducing or preventing lack of lubricant in the zone A11.

The angles θd1 and θu2 may each preferably be larger than or equal to 165 degrees, and more preferably be larger than or equal to 170 degrees. The angles θu1 and θd2 may each preferably be smaller than 165 degrees, and more preferably be smaller than or equal to 160 degrees.

Figure 8:
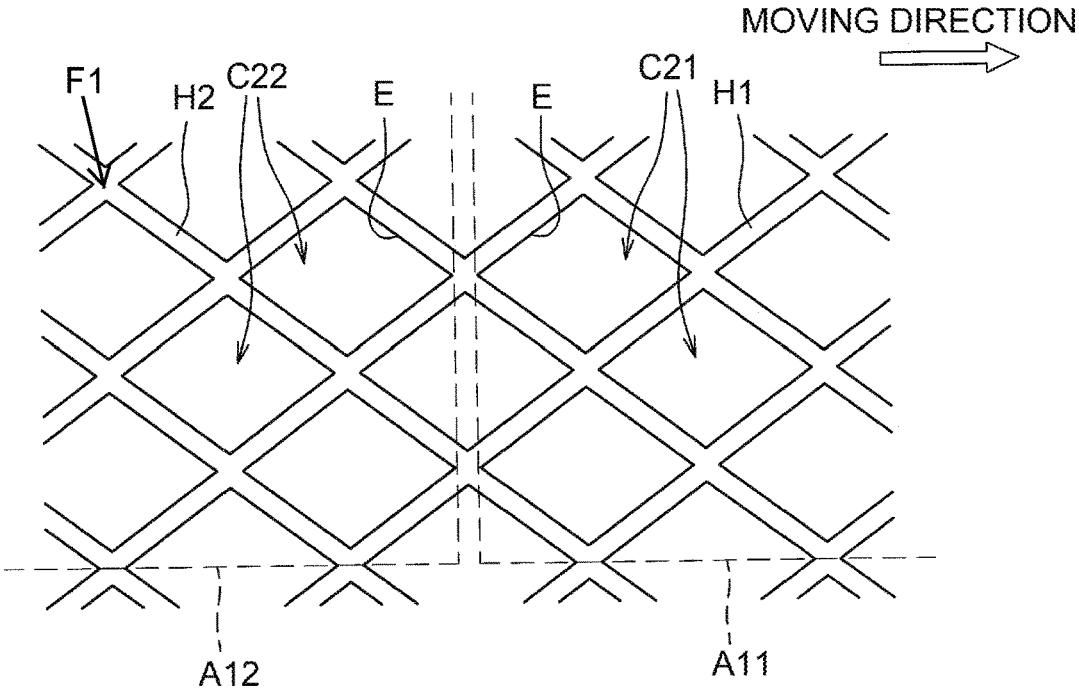
FIG. 8 is a plan view illustrating a portion of a sliding sheet including a plurality of first dimples and a plurality of second dimples in a third alternative embodiment according to one or more aspects of the disclosure.

In a third alternative embodiment, as illustrated in FIG. 8, a surface F1 of a sliding sheet 87 has a plurality of dimples C21 and a plurality of dimples C22 arranged in a regular pattern, e.g., in a lattice pattern. Each of dimples C21 and C22 has an opening E having a quadrangular shape when viewed in a direction perpendicular to the surface F1. The surface F further includes ridges H1 between the dimples C21 and ridges H2 between the dimples C22. More specifically, for example, the dimples C21 are arranged in a manner such that the ridges H1 form a lattice pattern and the dimples C22 are arranged in a manner such that the ridges H2 form a lattice pattern. Such dimples C21 and C22 having a quadrangular shape have the same cross-sectional shapes, respectively, as the cross-sectional shapes of the dimples C11 and C12 illustrated in FIG. 5B. With this configuration, the third alternative embodiment may achieve the same effects as the illustrative embodiment.

Figure 9A:
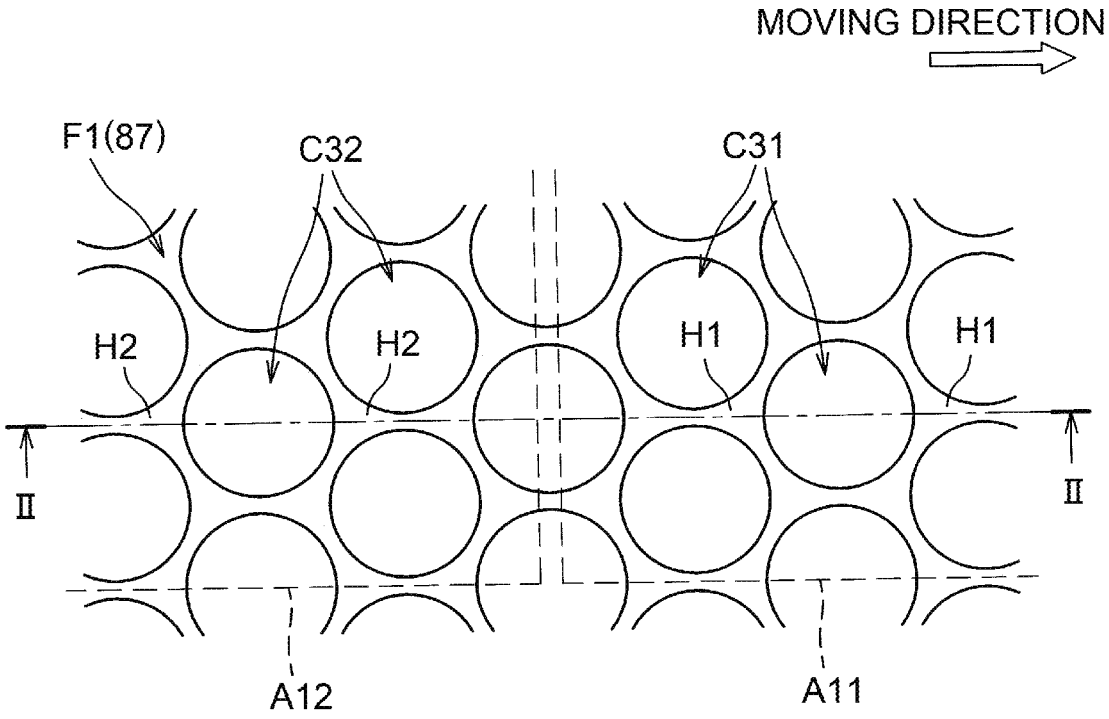
FIG. 9A is a plan view illustrating a portion of a sliding sheet including a plurality of first dimples and a plurality of second dimples in a fourth alternative embodiment according to one or more aspects of the disclosure.
Figure 9B:
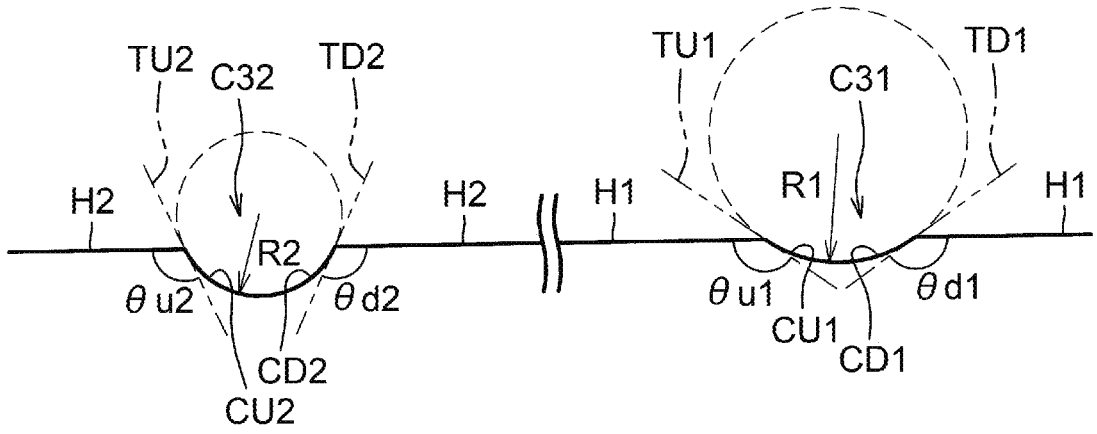
FIG. 9B is a cross-sectional view taken along line II-II of FIG. 9A in the third alternative embodiment according to one or more aspects of the disclosure.

In a fourth illustrative embodiment, as illustrated in FIGS. 9A and 9B, a surface F1 of a sliding sheet 87 has a plurality of dimples C31 and a plurality of dimples C32 arranged in a regular pattern, e.g., in a staggered pattern. Each of the dimples C31 and C32 has an opening E having a circular shape when viewed in a direction perpendicular to the surface F. Hereinafter, an arbitrary one of each of the dimples C31 and the dimples C32 will be described in detail, and a description for the others will be omitted as appropriate. Each of the dimples C31 and C32 has a spherical cap shape in cross section. The spherical shape includes any rounded shape such as an ellipsoid.

The surface F1 of the sliding sheet 87 includes ridges H1 and ridges H2 each having a flattened top. The ridges H1 are located between the dimples C31. The ridges H2 are located between the dimples C32. As illustrated in FIG. 9B, a dimple C31 includes a curved portion CD1 in its downstream portion in the moving direction and a curved portion CU1 in its upstream portion in the moving direction. Each of the curved portions CD1 and CU1 may be a curved line in cross section. A dimple C32 includes a curved portion CD2 in its downstream portion in the moving direction and a curved portion CU2 in its upstream portion in the moving direction. Each of the curved portions CD2 and CU2 may be a curved line in cross section.

The curved portion CD1 and the curved portion CU1 have the same radius of curvature, for example, a radius of curvature R1. The curved portion CD2 and the curved portion CU2 have the same radius of curvature, for example, a radius of curvature R2. The radius of curvature R1 is greater than the radius of curvature R2. The dimple C31 has a shallower depth than the dimple C32.

An imaginary tangent TD1 tangent to a downstream end of the curved portion CD1 and a ridge H1 connecting to the curved portion CD1 form an angle θd1. An imaginary tangent TD2 tangent to a downstream end of the curved portion CD2 and a ridge H2 connecting to the curved portion CD2 form an angle θd2. The angle θd1 is larger than the angle θd2.

An imaginary tangent TU1 tangent to an upstream end of the curved portion CU1 and a ridge H1 connecting to the curved portion CU1 form an angle θu1. The angle θd1 is equal to the angle θu1. An imaginary tangent TU2 tangent to an upstream end of the curved portion CU2 and a ridge H2 connecting to the curved portion CU2 form an angle θu2. The angle θd2 is equal to the angle θu2. The angles θd1, θd2, θu1, and θu2 according to the fourth alternative embodiment have the same preferable range as the angles θd1, θd2, θu1, and θu2, respectively, according to the illustrative embodiment and the first alternative embodiment.

In the fourth alternative embodiment, the angle θd1 of the dimple C31 is larger than the angle θd2 of the dimple C32. This configuration may thus enable the dimple C31 to release lubricant in the moving direction more easily than the dimple C32, thereby reducing accumulation of foreign matter in the dimple C31.

Figure 10:
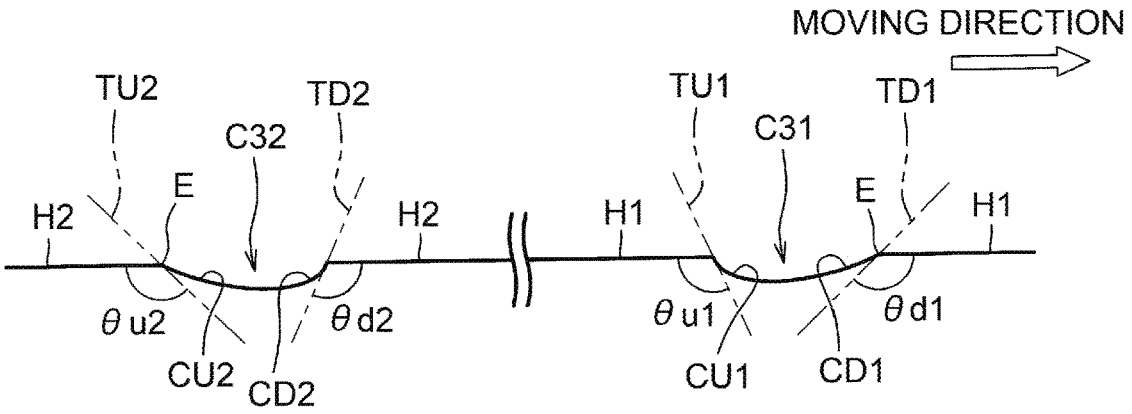
FIG. 10 is a cross-sectional view illustrating a portion of a sliding sheet including a first dimple and a second dimple in a fifth alternative embodiment according to one or more aspects of the disclosure.

In a fifth alternative embodiment, as illustrated in FIG. 10, a dimple C31 and a dimple C32 each have a spherical cap shape in cross section. An angle θd1 of the dimple C31 is larger than an angle θd2 of the dimple C32 as with the fourth alternative embodiment. Nevertheless, the angle θd1 is equal to an angle θu2 of the dimple C32 and the angle θd2 is equal to an angle θu1 of the dimple C31. The dimple C31 has an opening E having the same shape as the dimple C32. The dimple C31 and the dimple C32 have the same depth. The angles θd1, θd2, θu1, and θu2 according to the fifth alternative embodiment have the same preferable range as the angles θd1, θd2, θu1, and θu2, respectively, according to the second alternative embodiment.

Such a configuration may enable the dimple C31 and the dimple C32 to have an equal capacity. The dimple C31 having the angle θd1 larger than the angle θd2 of the dimple C32 may thus retain the same amount of lubricant as the dimple C32, thereby reducing or preventing lack of lubricant in the zone A11.

Figure 11:
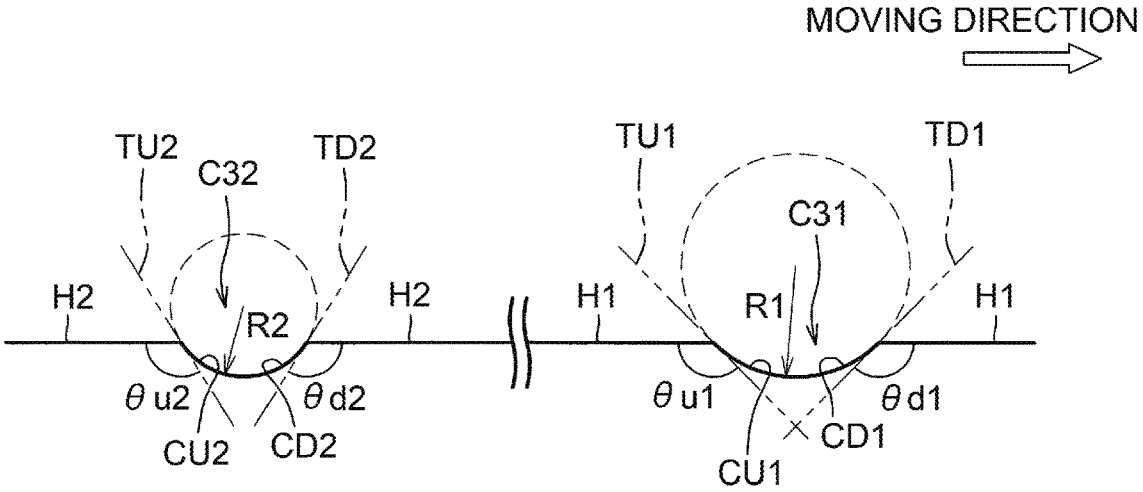
FIG. 11 is a cross-sectional view illustrating a portion of a sliding sheet including a first dimple and a second dimple in a sixth alternative embodiment according to one or more aspects of the disclosure.

In a sixth illustrative embodiment, as illustrated in FIG. 11, a dimple C31 and a dimple C32 each have a spherical cap shape in cross section. The dimples C31 and C32 have a similar configuration to the dimples C31 and C32, respectively, according to the fourth alternative embodiment except the dimples C31 and C32 according to the sixth alternative embodiment have the same depth. That is, a relationship between angles θd1, θu1, θd2, and θu2 and a relationship between the radii of curvature R1 and R2 according to the sixth alternative embodiment may be the same as the relationship between the angles θd1, θu1, θd2, and θu2 and the relationship between the radii of curvature R1 and R2 according to the fourth alternative embodiment. The angles θd1, θd2, θu1, and θu2 have the same preferable range as the angles θd1, θd2, θu1, and θu2, respectively, according to the illustrative embodiment. In the sixth alternative embodiment, the angle θd1 of the dimple C31 is larger than the angle θd2 of the dimple C32. This configuration may thus enable the dimple C31 to release lubricant in the moving direction more easily than the dimple C32, thereby reducing accumulation of foreign matter in the dimple C31.

Figure 12:
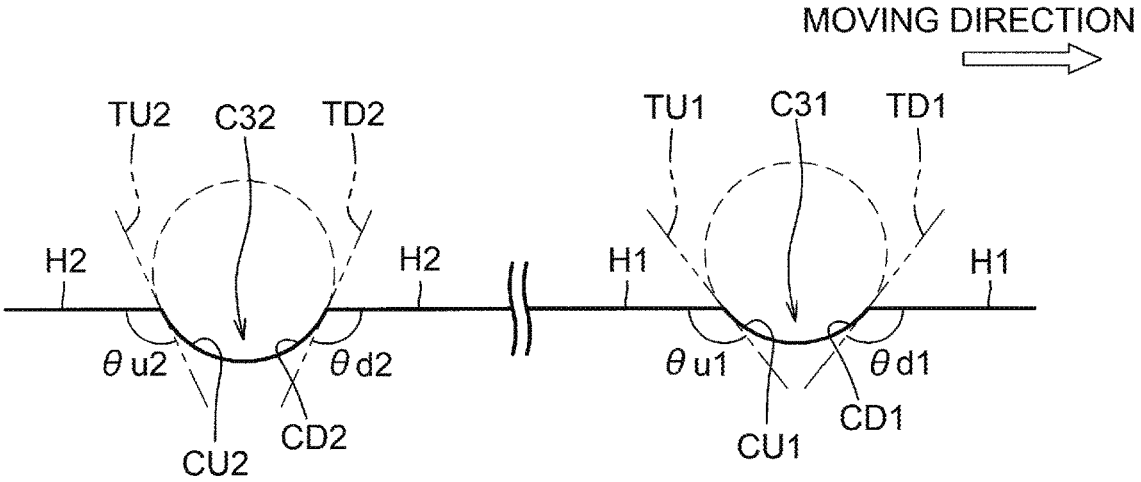
FIG. 12 is a cross-sectional view illustrating a portion of a sliding sheet including a first dimple and a second dimple in a seventh alternative embodiment according to one or more aspects of the disclosure.

In a seventh alternative embodiment, as illustrated in FIG. 12, a dimple C31 and a dimple C32 each have a spherical cap shape in cross section. The dimple C31 includes curved portions CD1 and CU1, and the dimple C32 includes curved portions CD2 and CU2. The curved portions CD1, CU1, CD2, and CU2 all have the same radius of curvature. Further, the dimple C31 has a shallower depth than the dimple C32. With this configuration, an angle θd1 of the dimple C31 is larger than an angle θd2 of the dimple C32. The angles θd1, θd2, θu1, and θu2 have the same preferable range as the angles θd1, θd2, θu1, and θu2, respectively, according to the illustrative embodiment. In the seventh alternative embodiment, the angle θd1 of the dimple C31 is larger than the angle θd2 of the dimple C32. This configuration may thus enable the dimple C31 to release lubricant in the moving direction more easily than the dimple C32, thereby reducing accumulation of foreign matter in the dimple C31.

In the illustrative embodiment, the pressure pad 85 that may be an elastic member made of, for example, rubber, is used as the nip forming member. Nevertheless, in other embodiments, for example, the nip forming member may have a plate shape and be made of rigid material such as resin, plastic or metal that is not elastically deformable under application of pressure. The nip forming member and the holder 86 may have a one-piece structure and may be inseparable. Nevertheless, the use of the rigid nip forming member may cause increase of the sliding resistance between the sliding sheet and the endless belt by flattening dimples in the surface of the sliding sheet due to long-term use of the sliding sheet and/or cause deterioration of image quality by impressions of the dimple patterns of the sliding sheet on the endless belt. For those reasons, it is preferable that the nip forming member include an elastic member such as rubber that may be elastically deformable in response to the dimple patterns of the sliding sheet under pressure.

In the illustrative embodiment, the halogen lamp is used as the heater 82. Nevertheless, in other embodiments, for example, a carbon heater may be used as the heater 82.

In the illustrative embodiments, the heat roller 81 including the heater 82 in its internal space is used as the cylindrical member. Nevertheless, in other embodiments, for example, an endless belt, whose inner circumferential surface may be heated by a heater, may be used as the cylindrical member. In another example, a heater may be disposed outside the cylindrical member and may heat an outer circumferential surface of the cylindrical member. In still another example, an induction heating ("IH") method may be used. In yet another example, a heater may be disposed inside the loop of the endless belt and may indirectly heat a cylindrical member contacting the outer circumferential surface of the endless belt. In still yet another example, a cylindrical member and an endless belt each may include a heater in its internal space.

In the illustrative embodiment, the fuser 8 includes the configuration for forming a nip portion. Nevertheless, in other embodiments, for example, another device or unit, for example, a sheet conveying system, may include such a configuration. For example, the configuration of the disclosure may be applied to a sheet conveying system that includes conveying rollers and a sheet conveying belt for conveying a sheet. More specifically, for example, the configuration of the disclosure may be provided inside a loop of the sheet conveying belt.

The configuration for forming a nip portion is not limited to the specific example (e.g., the fuser 8). In other embodiments, for example, a fuser may include a fusing roller, a pressure roller for forming a nip portion together with the fusing roller, and a heat unit for contacting the fusing roller with a predetermined nip pressure to heat the fusing roller. The fuser may be configured to fuse a toner image onto a sheet at the nip portion. Such a fuser may include the configuration according to the disclosure in the heat unit. More specifically, for example, in a case where the heat unit includes an endless belt, and a heat member that sandwiches the endless belt with the fusing roller, a sliding sheet may be provided between the heat member and the endless belt.

In the illustrative embodiment and the alternative embodiments, the disclosure has been applied to the laser printer 1. Nevertheless, in other embodiments, for example, the disclosure may be applied to other image forming apparatuses, such as copying machines and multifunction devices.

The one or more aspects of the disclosure may be implemented in various combinations of the elements described in the illustrative embodiments and alternative embodiments.

What is claimed is:

1. A fuser comprising:

a rotatable member;

a belt comprising:

an inner peripheral surface applied with lubricant, and an outer peripheral surface facing the rotatable member;

a heater configured to heat the rotatable member;

a pressure member configured to, with the rotatable member, sandwich the outer peripheral surface of the belt to form a nip portion; and a sliding member, a portion of the sliding member configured to be sandwiched between the inner peripheral surface of the belt and the pressure member at a position corresponding to the nip portion, the sliding member comprising a front surface facing the inner peripheral surface of the belt and a back surface facing the pressure member, wherein the front surface comprises a plurality of first dimples arranged in a first zone of the sliding member corresponding to the nip portion, to which a pressure is to be applied, and a plurality of second dimples arranged in a second zone of the sliding member corresponding to a portion outside of the nip portion in which the pressure member is not in contact with the sliding member, wherein the first dimples comprise a first upstream dimple and a first downstream dimple, positioned downstream from the first upstream dimple in a moving direction of the belt at the nip portion, wherein a first ridge portion is formed between the first upstream dimple and the first downstream dimple, wherein the second dimples comprise a second upstream dimple and a second downstream dimple positioned downstream from the second upstream dimple in the moving direction, wherein a second ridge portion is formed between the second upstream dimple and the second downstream dimple, wherein an angle formed between a bottom of the first upstream dimple and the first ridge portion is greater than an angle formed between a bottom of the second upstream dimple and the second ridge portion, wherein an angle formed between a bottom of the first downstream dimple and the first ridge portion is equal to the angle formed between the bottom of the second upstream dimple and the second ridge portion, and wherein an angle formed between a bottom of the second downstream dimple and the second ridge portion is equal to the angle formed between the bottom of the first upstream dimple and the first ridge portion.

2. A fuser comprising:

a rotatable member;

a belt comprising:

an inner peripheral surface applied with lubricant, and an outer peripheral surface facing the rotatable member;

a heater configured to heat the rotatable member;

a pressure member configured to, with the rotatable member, sandwich the outer peripheral surface of the belt to form a nip portion; and a sliding member, a portion of the sliding member configured to be sandwiched between the inner peripheral surface of the belt and the pressure member at a position corresponding to the nip portion, the sliding member comprising a front surface facing the inner peripheral surface of the belt and a back surface facing the pressure member, wherein the front surface comprises a plurality of first dimples arranged in a first zone of the sliding member corresponding to the nip portion, to which a pressure is to be applied, and a plurality of second dimples arranged in a second zone of the sliding member corresponding to a portion outside of the nip portion in which the pressure member is not in contact with the sliding member, wherein the first dimples comprise a first upstream dimple and a first downstream dimple, positioned downstream from the first upstream dimple in a moving direction of the belt at the nip portion, wherein a first ridge portion is formed between the first upstream dimple and the first downstream dimple, wherein the second dimples comprise a second upstream dimple and a second downstream dimple positioned downstream from the second upstream dimple in the moving direction, wherein a second ridge portion is formed between the second upstream dimple and the second downstream dimple, wherein an angle formed between the first upstream dimple and the first ridge portion is greater than an angle formed between the second upstream dimple and the second ridge portion, wherein an angle formed between the first downstream dimple and the first ridge portion is equal to the angle formed between the first upstream dimple and the first ridge portion, and wherein an angle formed between the second downstream dimple and the second ridge portion is equal to the angle formed between the second upstream dimple and the second ridge portion.

3. A fuser comprising:

a rotatable member;

a belt comprising:

an inner peripheral surface applied with lubricant, and an outer peripheral surface facing the rotatable member;

a heater configured to heat the rotatable member;

a pressure member configured to, with the rotatable member, sandwich the outer peripheral surface of the belt to form a nip portion; and a sliding member, a portion of the sliding member configured to be sandwiched between the inner peripheral surface of the belt and the pressure member at a position corresponding to the nip portion, the sliding member comprising a front surface facing the inner peripheral surface of the belt and a back surface facing the pressure member, wherein the front surface comprises a plurality of first dimples arranged in a first zone of the sliding member corresponding to the nip portion, to which a pressure is to be applied, and a plurality of second dimples arranged in a second zone of the sliding member corresponding to a portion outside of the nip portion in which the pressure member is not in contact with the sliding member, wherein the first dimples comprise a first upstream dimple and a first downstream dimple, positioned downstream from the first upstream dimple in a moving direction of the belt at the nip portion, wherein a first ridge portion is formed between the first upstream dimple and the first downstream dimple, wherein the second dimples comprise a second upstream dimple and a second downstream dimple positioned downstream from the second upstream dimple in the moving direction, wherein a second ridge portion is formed between the second upstream dimple and the second downstream dimple, wherein an angle formed between the first upstream dimple and the first ridge portion is greater than an angle formed between the second upstream dimple and the second ridge portion, and wherein each of the first dimples and each of the second dimples have pyramid shape.

4. The fuser according to claim 3, wherein each of the first dimples and each of the second dimples have hexagonal pyramid shape.

5. The fuser according to claim 4, wherein, in a direction perpendicular to the moving direction, each of the first dimples and each of the second dimples are arranged in honeycomb lattice.

6. The fuser according to claim 3, wherein each of the first dimples and each of the second dimples have quadrangular shape.

7. The fuser according to claim 6, wherein, in a direction perpendicular to the moving direction, each of the first dimples and each of the second dimples are arranged in lattice.

8. The fuser according to claim 1, wherein one of the second dimples is positioned upstream from the nip portion in the moving direction, and another of the second dimples is positioned downstream from the nip portion in the moving direction.

9. The fuser according to claim 1, wherein each of the first dimples and each of the second dimples has a spherical cap shape.

10. A fuser comprising:

a rotatable member;

a belt comprising:

an inner peripheral surface applied with lubricant, and an outer peripheral surface facing the rotatable member;

a heater configured to heat the rotatable member;

a pressure member configured to, with the rotatable member, sandwich the outer peripheral surface of the belt to form a nip portion; and a sliding member, a portion of the sliding member configured to be sandwiched between the inner peripheral surface of the belt and the pressure member at a position corresponding to the nip portion, the sliding member comprising a front surface facing the inner peripheral surface of the belt and a back surface facing the pressure member, wherein the front surface comprises a plurality of first dimples arranged in a first zone of the sliding member corresponding to the nip portion, to which a pressure is to be applied, and a plurality of second dimples arranged in a second zone of the sliding member corresponding to a portion outside of the nip portion in which the pressure member is not in contact with the sliding member, wherein the first dimples comprise a first upstream dimple and a first downstream dimple, positioned downstream from the first upstream dimple in a moving direction of the belt at the nip portion, wherein a first ridge portion is formed between the first upstream dimple and the first downstream dimple, wherein the second dimples comprise a second upstream dimple and a second downstream dimple positioned downstream from the second upstream dimple in the moving direction, wherein a second ridge portion is formed between the second upstream dimple and the second downstream dimple, wherein an angle formed between the first upstream dimple and the first ridge portion is greater than an angle formed between the second upstream dimple and the second ridge portion, and wherein a depth of each of the first dimples is equal to a depth of each of the second dimples.

11. The fuser according to claim 1, wherein a depth of each of the first dimples is different from a depth of each of the second dimples.

12. The fuser according to claim 1, wherein the sliding member comprises polyimide resin.

13. The fuser according to claim 1, wherein the rotatable member comprises a roller, and wherein the heater is disposed in an interior space of the roller.

14. The fuser according to claim 1, wherein the pressure member comprises an elastic pad.

15. The fuser according to claim 1, wherein the inner peripheral surface has lubricant thereon.

16. A fuser comprising:

a rotatable member;

a belt comprising:

an inner peripheral surface applied with lubricant, and an outer peripheral surface facing the rotatable member;

a heater configured to heat the rotatable member;

a pressure member configured to, with the rotatable member, sandwich the outer peripheral surface of the belt to form a nip portion; and a sliding member, a portion of the sliding member configured to be sandwiched between the inner peripheral surface of the belt and the pressure member at a position corresponding to the nip portion, the sliding member comprising a front surface facing the inner peripheral surface of the belt and a back surface facing the pressure member, wherein the front surface comprises a plurality of first dimples arranged in a first zone of the sliding member corresponding to the nip portion, to which a pressure is to be applied, and a plurality of second dimples arranged in a second zone of the sliding member corresponding to a portion outside of the nip portion in which the pressure member is not in contact with the sliding member, wherein the first dimples comprise a first upstream dimple and a first downstream dimple, positioned downstream from the first upstream dimple in a moving direction of the belt at the nip portion, wherein a first ridge portion is formed between the first upstream dimple and the first downstream dimple, wherein the second dimples comprise a second upstream dimple and a second downstream dimple positioned downstream from the second upstream dimple in the moving direction, wherein a second ridge portion is formed between the second upstream dimple and the second downstream dimple, wherein an angle formed between the first upstream dimple and the first ridge portion is greater than an angle formed between the second upstream dimple and the second ridge portion and, wherein a capacity of each of the first dimples is equal to a capacity of each of the second dimples.

17. The fuser according to claim 1, wherein a capacity of each of the first dimples is different from a capacity of each of the second dimples.

18. A fuser comprising:

a rotatable member;

a belt comprising:

an inner peripheral surface, and an outer peripheral surface facing the rotatable member;

a heater configured to heat the rotatable member;

a pressure member positioned to, with the rotatable member, sandwich the outer peripheral surface of the belt to form a nip portion; and a sliding member, a portion of the sliding member configured to be sandwiched between the inner peripheral surface of the belt and the pressure member at a position corresponding to the nip portion, the sliding member comprising a front surface facing the inner peripheral surface of the belt and a back surface facing the pressure member, wherein the front surface comprises a plurality of first dimples arranged in a first zone of the sliding member corresponding to the nip portion, to which a pressure is to be applied, and a plurality of second dimples arranged in a second zone of the sliding member corresponding to a portion outside of the nip portion in which the pressure member is not in contact with the sliding member, wherein the first dimples comprise a first upstream dimple and a first downstream dimple, positioned downstream from the first upstream dimple in a moving direction of the belt at the nip portion, wherein a first ridge portion is formed between the first upstream dimple and the first downstream dimple, wherein the second dimples comprise a second upstream dimple and a second downstream dimple positioned downstream from the second upstream dimple in the moving direction, wherein a second ridge portion is formed between the second upstream dimple and the second downstream dimple, and wherein a slope of an edge of the first upstream dimple in the moving direction relative to the first ridge portion is steeper than a slope of an edge of the second upstream dimple in the moving direction relative to the second ridge portion.

* * * * *